US008100068B2

(12) United States Patent
Suzuki

(10) Patent No.: US 8,100,068 B2
(45) Date of Patent: Jan. 24, 2012

(54) THREADER OF SEWING MACHINE

(75) Inventor: Yoshikazu Suzuki, Moriguchi (JP)

(73) Assignee: Jaguar International Corporation, Osaka (JP)

( * ) Notice: Subject to any disclaimer, the term of this patent is extended or adjusted under 35 U.S.C. 154(b) by 429 days.

(21) Appl. No.: 12/524,155

(22) PCT Filed: Nov. 13, 2007

(86) PCT No.: PCT/JP2007/071990

§ 371 (c)(1), (2), (4) Date: Jul. 22, 2009

(87) PCT Pub. No.: WO2008/090663

PCT Pub. Date: Jul. 31, 2008

(65) Prior Publication Data

US 2010/0043686 A1 Feb. 25, 2010

(30) Foreign Application Priority Data

Jan. 25, 2007 (JP) ..... 2007-014450

(51) Int. Cl.
*D05B 87/02* (2006.01)

(52) U.S. Cl. ..... 112/225

(58) Field of Classification Search ..... 112/225, 112/224, 302, 470.01, 255

See application file for complete search history.

(56) References Cited

U.S. PATENT DOCUMENTS

| | | | | |
|---|---|---|---|---|
| 5,615,629 | A * | 4/1997 | Yamada et al. | 112/225 |
| 6,067,919 | A * | 5/2000 | Shoji | 112/225 |
| 6,918,344 | B2 * | 7/2005 | Ebata et al. | 112/225 |
| 6,973,888 | B2 * | 12/2005 | Yoshikazu | 112/225 |
| 7,178,473 | B2 * | 2/2007 | Mizuno et al. | 112/225 |
| 7,281,479 | B2 * | 10/2007 | Watanabe et al. | 112/225 |

FOREIGN PATENT DOCUMENTS

| | | |
|---|---|---|
| JP | 2917438 | 2/1992 |
| JP | 3730300 | 7/1997 |
| JP | 11-333182 | 12/1999 |
| JP | 2002-200386 | 7/2002 |
| JP | 2002-200387 | 7/2002 |
| JP | 2005-160592 | 6/2005 |

* cited by examiner

*Primary Examiner* — Danny Worrell

(74) *Attorney, Agent, or Firm* — Husch Blackwell LLP

(57) ABSTRACT

The present invention provides a threader of a sewing machine in which the entire head portion can be made compact and the operator can perform threading work with one hand. The threader comprises: a threading shaft approaching a needle bar for moving a supporting sewing needle vertically; a threading hook for moving a hook portion in and out of a needle hole; a positioning member for regulating a lowermost position of the threading shaft to a position where the height of the hook portion matches that of the needle hole; a first rotary mechanism for rotating by a predetermined angle near the lowermost point of the threading shaft so that the hook portion is inserted into the needle hole of the sewing needle; and a thread-guiding member for guiding the top thread to the hook portion at a near lowermost point of the threading shaft. The threader further comprises a second rotary mechanism for rotating by a predetermined angle so that a thread-catching portion of the thread-guiding member passes through the position of the needle hole of the sewing needle at a near lowermost point of the threading shaft, and the first rotary mechanism and the second rotary mechanism rotate the threading hook and the thread-guiding member in opposite directions.

2 Claims, 9 Drawing Sheets

THREADER OF SEWING MACHINE

TECHNICAL FIELD

The present invention relates to a threader of a sewing machine that performs a threading operation into a needle hole using a hook portion that is disposed at the lower end portion of a threading shaft, by lowering and rotating the threading shaft arranged near a needle bar.

BACKGROUND ART

Conventionally, in a sewing operation that sews in a processed fabric using a sewing machine, a sewing machine comprising a threader that can easily perform a threading operation into a needle hole of a sewing needle has been put into practice (see JP 2005-160592A and JP 2002-200386A). For example, in JP 2005-160592A, when an operator lowers a threading lever, a threading shaft and a slider guide shaft are lowered, and the height positions of the threading shaft and the slider guide shaft are regulated when a slider pin at the upper end portion of the threading shaft is brought into contact with a catching portion on the side of a needle bar. Subsequently, when the threading lever is further lowered, the threading shaft comprising the slider pin is rotated by a predetermined angle by a cam mechanism including a slider pin, a hook that is disposed at the lower end portion of the threading shaft is inserted into a needle hole, and then the threading operation is performed.

However, in JP 2005-160592A, it is necessary to manually place a thread over the hook, and, thus, there is a problem in that the operator has to use both hands to perform a threading work. Thus, in JP 2002-200386A, a top thread taken from a bobbin is placed at a predetermined position in the sewing machine and, when the operator lowers the threading lever, the height positions of a threading shaft and a slider guide shaft are regulated when a slider pin at the upper end portion of the threading shaft is brought into contact with a catching portion on the side of a needle bar.

Subsequently, when the threading lever is further lowered, the threading shaft comprising the slider pin is rotated by a predetermined angle by a cam mechanism including the slider pin, and a hook that is disposed at the lower end portion of the threading shaft is inserted into a needle hole. The hook that has been inserted into the needle hole catches the placed top thread, and, when the threading lever is lifted, the threading operation is performed as the hook moves out of the needle hole. In this manner, the operator can perform the threading operation only with an operation that lowers or lifts the threading lever.

DISCLOSURE OF THE INVENTION

Problem to be Solved by the Invention

However, in JP 2002-200386A, as clearly shown in FIGS. 5 and 7, it is necessary to use not only the needle bar but also two operating shafts comprising the threading shaft and the slider guide shaft in order to control the movement of a hook mechanism fixed to the lower end portion of the threading shaft and to reliably perform the threading operation of a top thread. Thus, the inertia of the head portion including the needle bar of the sewing machine is large, and, thus, there is a problem in that an operation, such as forming zigzag stitches, that requires fine movement cannot be performed at high speed.

Furthermore, the number of parts increases, and, thus, there is a problem in that it is difficult to make the entire head portion compact and to reduce the cost.

The present invention was made in view of these circumstances, and it is an object thereof to provide a threader of a sewing machine in which the entire head portion can be made compact and the operator can reliably perform a threading work with one hand.

Means for Solving Problem

In order to achieve the above-described object, a first aspect of the present invention is directed to a threader of a sewing machine, comprising a threading shaft arranged near a needle bar for moving a supporting sewing needle vertically capable of moving vertically and supported for rotating around an axis, a threading hook having a hook portion fixed to a lower end portion of the threading shaft, and capable of being inserted into a needle hole of the sewing needle, and a first guiding portion for guiding the hook portion to the needle hole, a positioning member for regulating a lowermost position of the threading shaft to a position where the height of the hook portion matches that of the needle hole of the sewing needle, a first rotary mechanism for rotating the first guiding portion by a predetermined angle so that the hook portion is inserted into the needle hole of the sewing needle at a near lowermost point of the threading shaft, and a thread-guiding member for guiding a top thread to the hook portion near the lowermost point of the threading shaft can be lowered, wherein the thread-guiding member comprises a thread-catching portion for catching a thread, and a second guiding portion for guiding the thread-catching portion toward the sewing needle, the threader further comprises a second rotary mechanism for rotating the second guiding portion by a predetermined angle so that the thread-catching portion is guided towards the needle bar and a thread caught by the thread-catching portion is guided to a position near a hook portion of the threading hook near lowermost point of the threading shaft, the first rotary mechanism and the second rotary mechanism rotate the threading hook and the thread-guiding member in opposite directions, the threader comprises a threading-leading member that is externally fitted or internally fitted to the threading shaft thereby being fixed to a body of the sewing machine, and that has a first cam hole and a second cam hole on a circumferential face, wherein the first rotary mechanism comprises the first cam hole, and a first cam shaft that is disposed on the threading shaft and that is fitted to the first cam hole, the second rotary mechanism comprises the second cam hole, and a second cam shaft that is disposed on the thread-guiding member and that is fitted to the second cam hole, and a direction in which the first cam hole is inclined is an opposite of a direction in which the second cam hole is inclined, a width in the vertical direction of the first cam hole at a near uppermost portion is larger than a shaft diameter of the first cam shaft, and a biasing member is disposed between the threading hook and the thread-guiding member so as to bias the threading hook and the thread-guiding member away from each other.

Furthermore, a second aspect of the present invention is directed to the threader of the sewing machine according to the first aspect, further comprising a threading-leading member that is externally fitted or internally fitted to the threading shaft thereby being fixed to a body of the sewing machine, and that has a first cam hole and a second cam hole on a circumferential face, wherein the first rotary mechanism comprises the first cam hole, and a first cam shaft that is disposed on the threading shaft and that is fitted to the first cam hole, the second rotary mechanism comprises the second cam hole, and a second cam shaft that is disposed on the thread-guiding member and that is fitted to the second cam hole, and a direction in which the first cam hole is inclined is an opposite of a direction in which the second cam hole is inclined.

Furthermore, a third aspect of the present invention is directed to the threader of the sewing machine according to the first or second aspect, wherein a width in the vertical direction of the first cam hole at a near uppermost portion is larger than a shaft diameter of the first cam shaft, and a biasing member is disposed between the threading hook and the thread-guiding member so as to bias the threading hook and the thread-guiding member away from each other.

Furthermore, a fourth aspect of the present invention is directed to the threader of the sewing machine according to any one of the first to third aspects, further comprising an operating member that can operate the threading shaft and that can move the threading shaft vertically.

According to the first aspect, the threader comprises one threading shaft arranged near a needle bar for moving a supporting sewing needle vertically and a supporting rotating around an axis. The lower end portion of the threading shaft has a threading hook that comprises a hook portion capable of being inserted into a needle hole of the sewing needle and a first guiding portion for guiding the hook portion to the needle hole. A first rotary mechanism rotates the first guiding portion by a predetermined angle so that the hook portion is inserted into the needle hole of the sewing needle at a near lowermost point of the threading shaft. A thread-guiding member rotates and guides a thread-catching portion toward the sewing needle, and a second rotary mechanism rotates a second guiding portion by a predetermined angle so that the thread-catching portion is guided towards the needle bar and a thread caught by the thread-catching portion is guided to a position near a hook portion of the threading hook near lowermost point of the threading shaft. The direction in which the first rotary mechanism rotates the threading hook is the opposite of the direction in which the second rotary mechanism rotates the thread-guiding member. The hook portion inserting into the needle hole of the sewing needle and the thread-catching portion catching a thread can be moved closer to or away from each other by moving the threading shaft vertically. Accordingly, in a state where a top thread is caught by the thread-catching portion which rotates together with the second guiding portion, the hook portion rotating together with the first guiding portion is inserted into the needle hole, and then the top thread is caught by the hook portion. As the hook portion is pulled out of the needle hole, the top thread is inserted into the needle hole. Accordingly, the threading operation can be reliably performed according to the vertical movement of the threading shaft, and, thus, the entire head portion can be made compact, and the cost can be reduced. Furthermore, even during a sewing operation that requires fine movement, the inertia of the moving portion is small, and, thus, the sewing speed does not have to be reduced in order to maintain sewing precision.

According to the second aspect, the threader further comprises a threading-leading member that is externally fitted or internally fitted to the threading shaft thereby being fixed to a body of the sewing machine, and that has a first cam hole and a second cam hole on a circumferential face, wherein the first rotary mechanism comprises the first cam hole, and a first cam shaft that is disposed on the threading shaft and that is fitted to the first cam hole, the second rotary mechanism comprises the second cam hole, and a second cam shaft that is disposed on the thread-guiding member and that is fitted to the second cam hole, and a direction in which the first cam hole is inclined is an opposite of a direction in which the second cam hole is inclined. When the first rotary mechanism rotates clockwise (counterclockwise) around the threading shaft, the second rotary mechanism rotates counterclockwise (clockwise) around the threading shaft. Accordingly, the relative rotational movement of the thread-catching portion guiding a top thread and the hook portion that threads the thread into the needle hole can be controlled by moving the threading shaft vertically, and, thus, the threading operation can be reliably performed. Thus, the entire head portion can be made compact, and the cost can be reduced.

According to the third aspect, a width in the vertical direction of the first cam hole at a near uppermost portion is larger than a shaft diameter of the first cam shaft. Thus, the second guiding portion, that is, the thread-catching portion having caught a top thread can be lowered further after the rotation of the first guiding portion, that is, the hook portion that performs the threading operation stops. Furthermore, a biasing member, such as a spring, that biases the threading hook and the thread-guiding member away from each other is disposed between the threading hook and the thread-guiding member, and, thus, the thread-guiding member can be moved to the original position, that is, a position where a top thread can be caught by the hook portion, before the hook portion moves out of the needle hole. Accordingly, for example, when the hook portion is inserted into the needle hole in a state where the thread-catching portion has been moved to a position lower than the threading hook, and the thread-catching portion is lifted before the hook portion moves out of the needle hole, the hook portion can be pulled out of the needle hole in a state where the top thread has been reliably caught by the hook portion, and, thus, the threading operation can be reliably performed.

According to the fourth aspect, the threader further comprises an operating member that can operate the threading shaft and that can move the threading shaft vertically, and, thus, the threading work can be performed with one hand.

Effects of the Invention

According to the first aspect, the direction in which the first rotary mechanism rotates the first guiding portion is the opposite of the direction in which the second rotary mechanism rotates the second guiding portion. The hook portion inserting into the needle hole of the sewing needle and the thread-catching portion catching a thread can be moved closer to or away from each other by moving the threading shaft vertically. Accordingly, in a state where a top thread is caught by the thread-catching portion that rotates together with the second guiding portion, the hook portion that rotates together with the first guiding portion is inserted into the needle hole, and then the top thread is caught by the hook portion. As the hook portion is pulled out of the needle hole, the top thread is inserted into the needle hole. Accordingly, the threading operation can be reliably performed according to the vertical movement of the threading shaft, and, thus, the entire head portion can be made compact, and the cost can be reduced. Furthermore, even during a sewing operation that requires fine movement, the inertia of the moving portion is small, and, thus, the sewing speed does not have to be reduced in order to maintain sewing precision.

According to the second aspect, the direction in which the first cam hole is inclined is the opposite of the direction in which the second cam hole is inclined. When the first rotary mechanism rotates clockwise (counterclockwise) around the threading shaft, the second rotary mechanism rotates counterclockwise (clockwise) around the threading shaft. Accordingly, the relative rotational movement of the thread-catching portion guiding a top thread and the hook portion that passes the thread through the needle hole can be controlled by moving the threading shaft vertically, and, thus, the threading operation can be reliably performed. Thus, the entire head portion can be made compact, and the cost can be reduced.

According to the third aspect, the second guiding portion, that is, the thread-catching portion having caught a top thread can be lowered further after the rotation of the first guiding portion, that is, the hook portion that performs the threading operation stops. Furthermore, a biasing member, such as a spring, that biases the threading hook and the thread-guiding member away from each other is disposed between the threading hook and the thread-guiding member, and, thus, the thread-guiding member can be moved to the original position, that is, a position where a top thread can be caught by the hook portion, before the hook portion moves out of the needle hole. Accordingly, for example, when the hook portion is inserted into the needle hole in a state where the thread-catching portion has been moved to a position lower than the threading hook, and the thread-catching portion is lifted before the hook portion moves out of the needle hole, the hook portion can be pulled out of the needle hole in a state where the top thread has been reliably caught by the hook portion, and, thus, the threading operation can be reliably performed.

According to the fourth aspect, the operator can move the threading shaft vertically and rotate it by moving the operating member vertically. Thus, the present invention achieves an excellent effect in which the threading work can be performed with one hand.

DESCRIPTION OF THE NUMERALS

Figure 1:
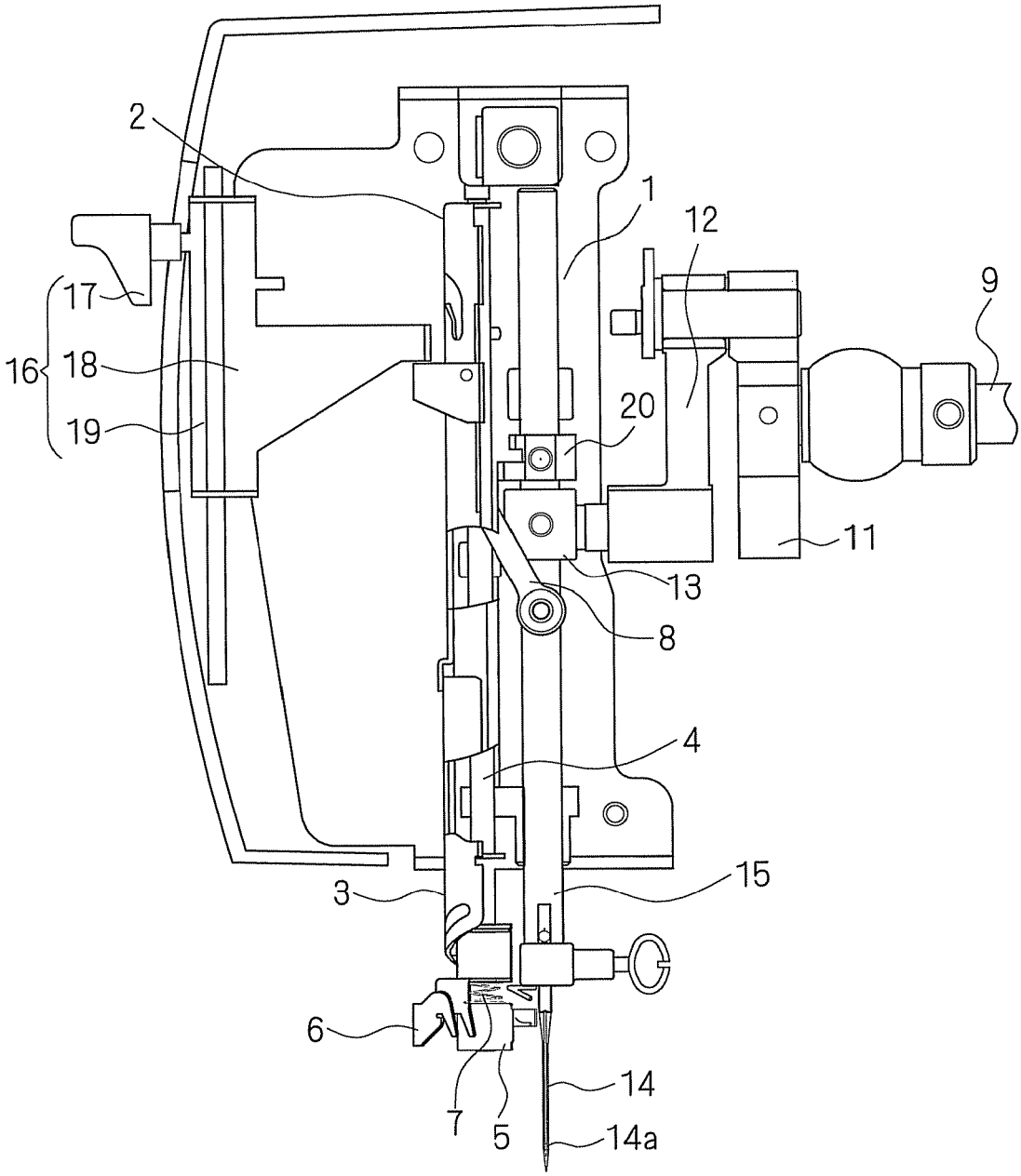
FIG. 1 is a cross-sectional view taken along a plane in the left-and-right direction including a needle bar, showing the configuration of an arm portion of a sewing machine according to an embodiment of the present invention.

2 first threading-leading portion
3 second threading-leading portion
4 threading shaft
5 threading hook
6 thread-guiding member
13 needle bar-connecting bracket
14 sewing needle
14*a* needle hole
15 needle bar
17 operating member
20 cam control member
21 first cam hole
31 second cam hole
41 first cam shaft
51 first guiding portion
52 hook portion
61 second guiding portion
62 thread-catching portion
63 second cam shaft

DESCRIPTION OF THE INVENTION

Hereinafter, an embodiment of the present invention will be described with reference to the drawings. In the following description, "front", "rear", "left" and "right" refer to the front, rear, left and right directions viewed by an operator operating the sewing machine. FIG. 1 is a cross-sectional view taken along a plane in the left-and-right direction including a needle bar, showing the configuration of an arm portion of a sewing machine according to the embodiment of the present invention. As shown in FIG. 1, the arm portion of the sewing machine according to this embodiment comprises a needle bar-supporting portion 1, a needle bar 15, a threading shaft 4 arranged near the needle bar 15, and a first threading-leading portion 2 and a second threading-leading portion 3 that include the threading shaft 4, that can move in the vertical direction, and that can rotate around the central axis of the threading shaft 4.

The vertical movement of the needle bar 15 is performed as follows. As shown in FIG. 1, the left end portion of a main shaft 9 has a balance crank 11 of a balance mechanism (not shown), and the balance crank 11 is linked via a crank pin to a needle bar crank rod 12 so that it can freely rotate. A needle bar-connecting bracket 13 is linked to the substantially middle portion of the needle bar 15, and the needle bar crank rod 12 is linked to the needle bar-connecting bracket 13.

In a sewing operation, a sewing machine motor rotationally drives the main shaft 9, and the needle bar crank rod 12 drives the needle bar 15 in the vertical direction up and down. Here, a mechanism that uses a stepping motor or the like to swingingly drive a sewing needle 14 via the needle bar-supporting portion 1 is not particularly limited, and it is possible to use any ordinary mechanism, and, thus, a detailed description has been omitted.

The lower end portion of the threading shaft 4 has a threading hook 5 that can be inserted into a needle hole 14*a* of the sewing needle 14. The upper portion of the threading hook 5 is linked to a thread-guiding member 6 that can rotate independently of the threading shaft 4 so as to guide a thread to the threading hook 5, via a compression spring 7 that biases the thread-guiding member 6 up toward the threading hook 5.

The positions of the threading hook 5 and the needle hole 14*a* of the sewing needle 14 can be adjusted to more appropriate positions by a positioning plate (positioning member) 8. At the top portion of the arm portion, the needle bar-supporting portion 1 supporting the needle bar 15 in a vertically movable manner is arranged in the vertical direction, and the upper end portion of the needle bar-supporting portion 1 is supported by the frame of the sewing machine in a swingable manner.

Here, the threading shaft 4 may move vertically in conjunction with the vertical movement of the needle bar 15, but there is no limitation to this. For example, it is preferable to provide an operating mechanism 16 that can be operated with one hand of the operator as shown in FIG. 1. In the example of FIG. 1, the operating mechanism 16 comprises an operating member (operating lever) 17, a threading shaft-linking plate 18 that is linked to the threading shaft 4, and an operating member shaft 19. When the operating member 17 is moved vertically, the threading shaft 4 and the needle bar 15 move vertically in conjunction with the movement. Accordingly, the operator can move the threading shaft 4 vertically and rotate it by moving the operating member 17 vertically, and, thus, the threading work can be performed with one hand.

Figure 2:
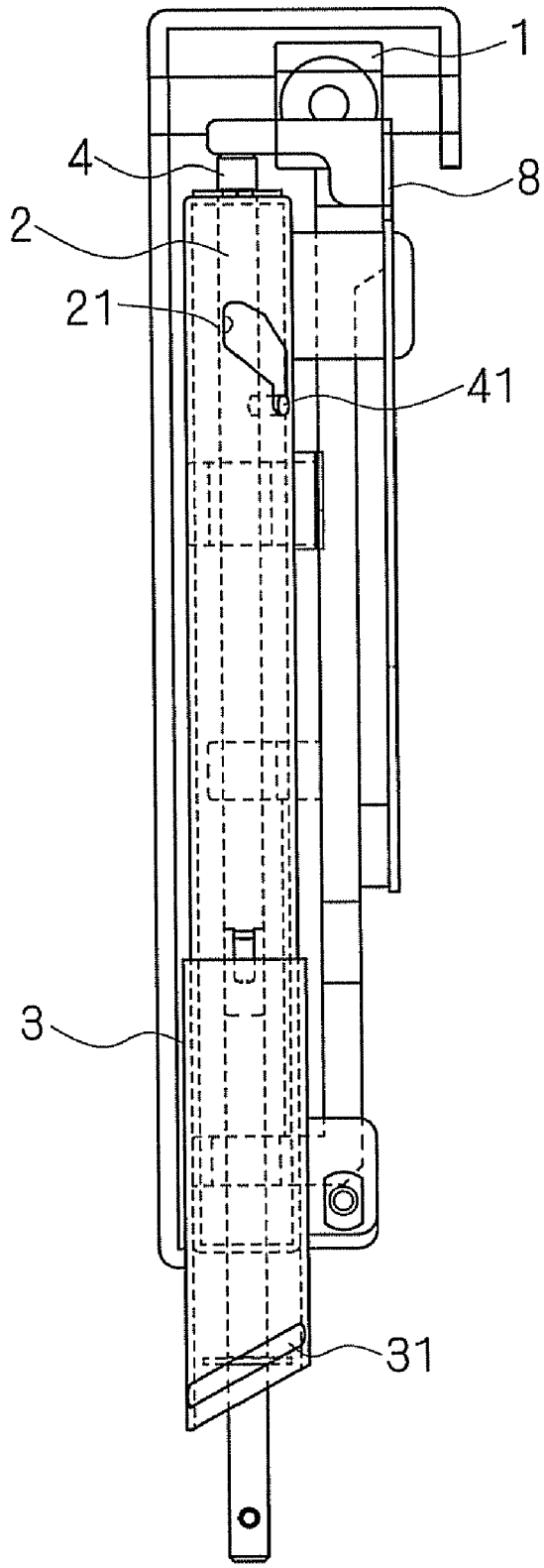
FIG. 2 is a cross-sectional view showing the operation of a threading bar in the threader of the sewing machine according to the embodiment of the present invention.

Next, the threader threading on a top thread into the needle hole 14*a* of the sewing needle 14 will be described. FIG. 2 is a cross-sectional view showing the operation of the threading bar 4 in the threader of the sewing machine according to the embodiment of the present invention. As shown in FIG. 2, the threading bar 4 according to the embodiment is linked via a cylinder cam mechanism to the first threading-leading portion 2 and the second threading-leading portion 3. Here, the first threading-leading portion 2 and the second threading-leading portion 3 are fixed to the needle bar-supporting portion 1 moving vertically close to the first threading-leading portion 2 and the second threading-leading portion 3. In this embodiment, in order to ensure the function of the cylinder cam mechanism, a threading-leading portion is divided into two portions, and each portion is screwed to the needle bar-supporting portion 1 so that the threading-leading portions are more firmly fixed to the needle bar-supporting portion 1. There is no specific problem if the threading-leading portion may be integrally formed instead of being separately formed.

The threading bar 4 is disposed so that a first cam shaft 41 that can be fitted to a first cam hole 21 disposed at the first threading-leading portion 2 projects from the circumferential face. When the first threading-leading portion 2 and the second threading-leading portion 3 are lowered (lifted) in conjunction with the downward movement of the needle bar 15, the first cam shaft 41 moves along the first cam hole 21, and the threading hook 5 disposed at the lower end of the threading bar 4 rotates clockwise (counterclockwise) when viewed from above (a first rotary mechanism).

A second cam shaft (not shown) that can be fitted to a second cam hole 31 disposed at the second threading-leading portion 3 is disposed at the thread-guiding member 6 that is linked rotatably at the lower end portion of the threading bar 4. When the first threading-leading portion 2 and the second threading-leading portion 3 are lowered (lifted) in conjunction with the downward movement of the needle bar 15, the second cam shaft moves along the second cam hole 31, and the thread-guiding member 6 disposed at the lower end of the threading bar 4 rotates in the opposite direction to the threading hook 5, that is, counterclockwise (clockwise) when viewed from above (a second rotary mechanism). In this manner, the threading hook 5 and the thread-guiding member 6 move closer to or away from each other according to the vertical movement and rotation of the threading shaft 4, and, thus, the threading operation into the needle hole 14*a* can be controlled only by the threading shaft 4.

Figure 3A:
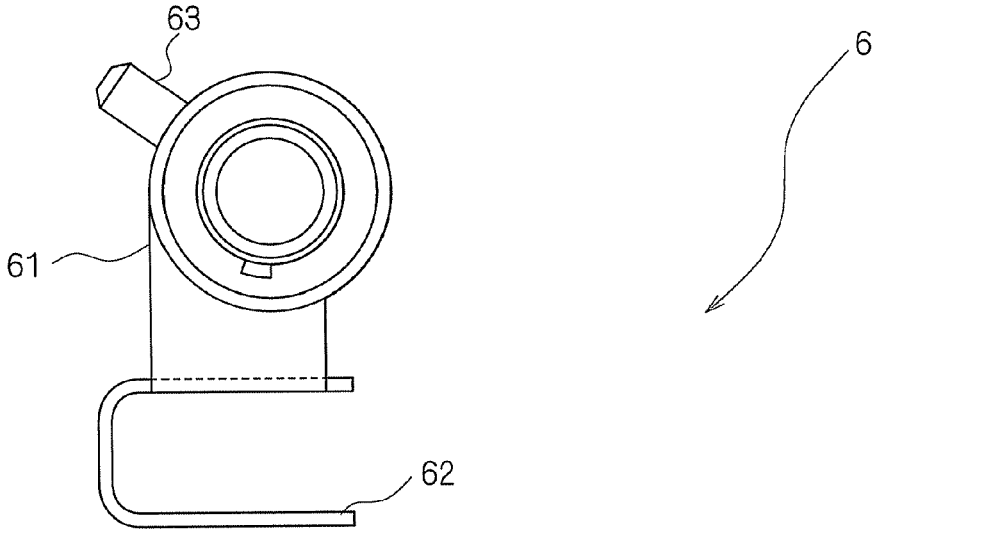
FIGS. 3A-3C shows three views (a plan view, a front view and a side view) showing the configuration of a thread-guiding member in the threader of the sewing machine according to the embodiment of the present invention.
Figure 3B:
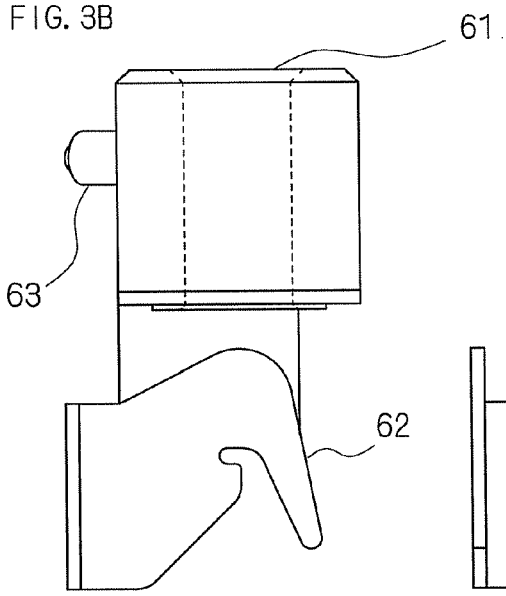
Figure 3C:
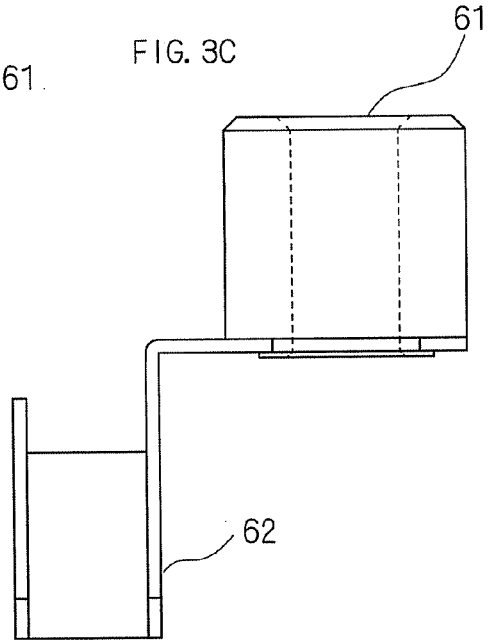

FIG. 3 shows three views (a plan view, a front view and a side view) showing the configuration of the thread-guiding member 6 in the threader of the sewing machine according to the embodiment of the present invention. FIG. 3A shows a plan view of the thread-guiding member 6 in the threader of the sewing machine according to the embodiment of the present invention. FIG. 3B shows a front view thereof. FIG. 3C shows a side view thereof. The thread-guiding member 6 comprises a second guiding portion 61 rotating around the threading shaft 4, and a thread-catching portion 62 branching at the end portion of the second guiding portion 61 into two portions so as not to interfere with the needle bar 15. The second guiding portion 61 has a second cam shaft 63 fitting to the second cam hole 31 disposed at the second threading-leading portion 3. The second cam shaft 63 moves along the second cam hole 31, and the thread-guiding member 6 rotates counterclockwise (clockwise) when viewed from above the threading shaft 4. According to the rotation of the second guiding portion 61 of the thread-guiding member 6, the thread-catching portion 62 is guided to the needle bar 15, and a thread caught by the thread-catching portion 62 is guided to a position near a hook portion 52 of the threading hook 5 (see FIG. 4).

Figure 4A:
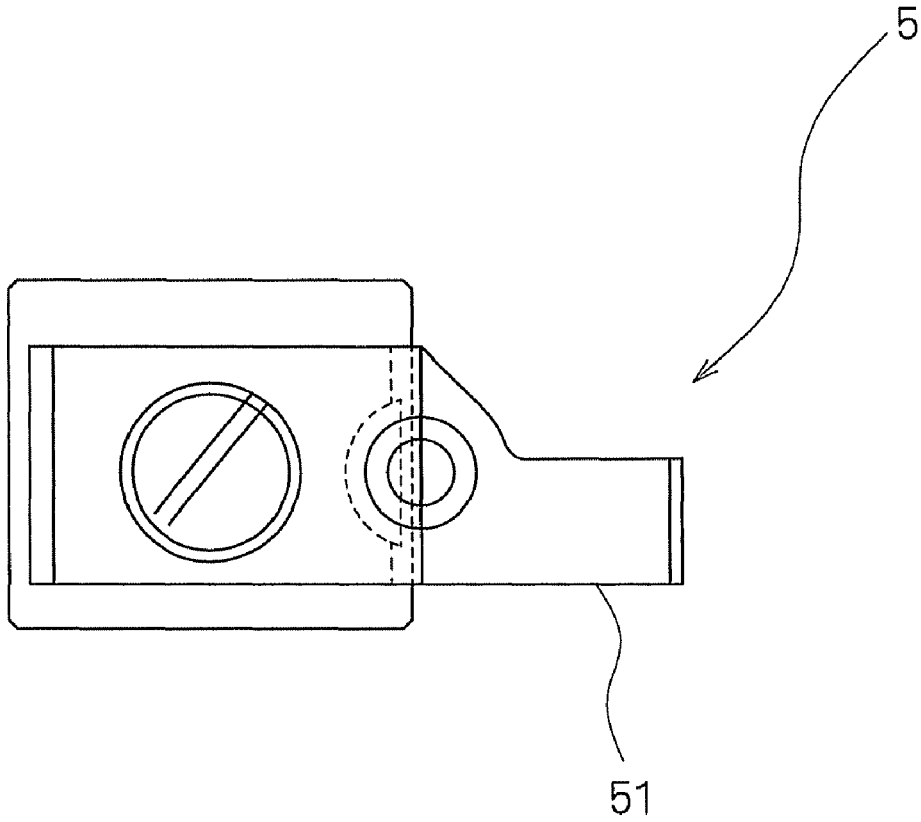
FIGS. 4A-4B shows two views (a plan view and a front view) showing the configuration of a threading hook in the threader of the sewing machine according to the embodiment of the present invention.
Figure 4B:
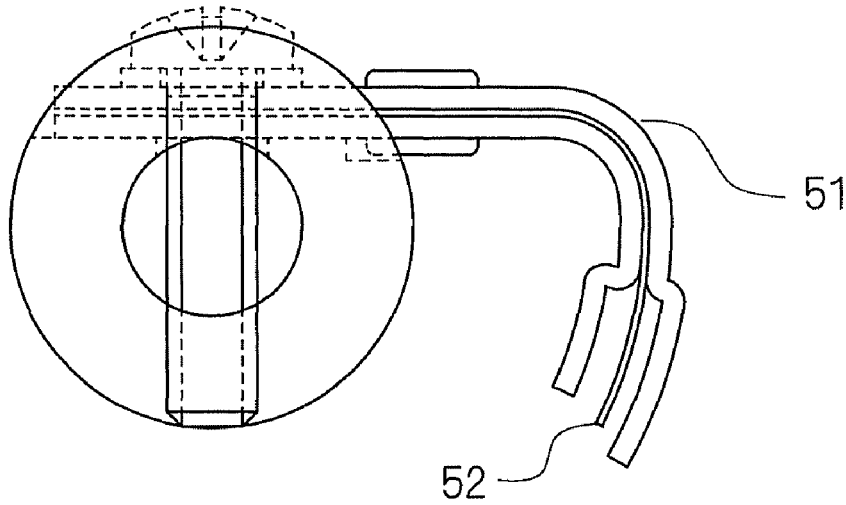

FIG. 4 shows two views (a plan view and a front view) showing the configuration of the threading hook 5 in the threader of the sewing machine according to the embodiment of the present invention. FIG. 4(*a*) shows a front view showing the configuration of the threading hook 5 in the threader of the sewing machine according to the embodiment of the present invention. FIG. 4B shows a plan view thereof. The threading hook 5 comprises a first guiding portion 51 rotating around the threading shaft 4, and the hook portion 52 arranged at the end portion of the first guiding portion 51 and that catches a thread. According to the rotation of the first guiding portion 51, the hook portion 52 moves in and out of the needle hole 14*a* of the sewing needle 14, and the threading operation into the needle hole 14*a* is performed with the hook portion 52.

Figure 5:
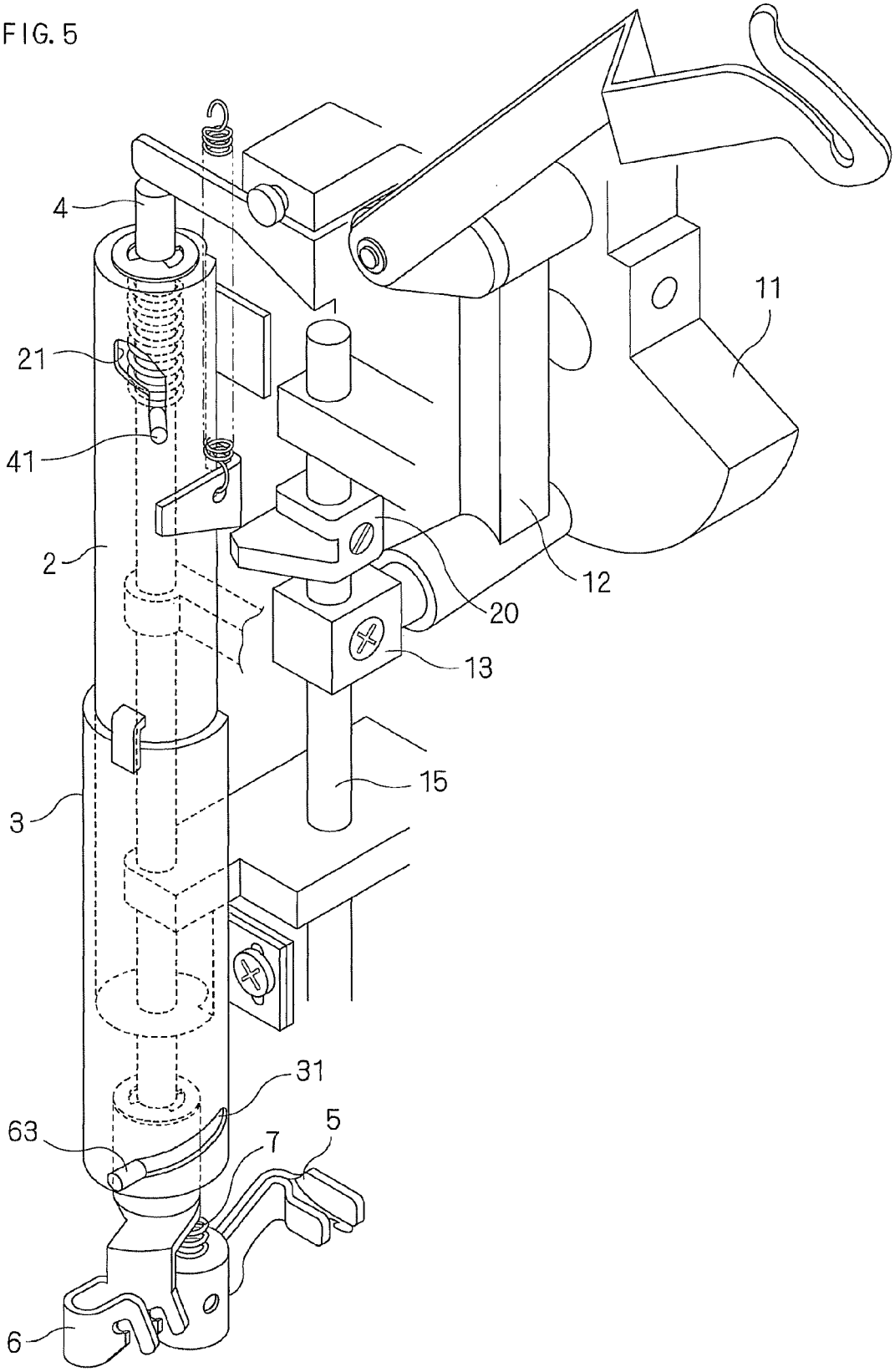
FIG. 5 is a perspective view showing the outline of the threader of the sewing machine according to the embodiment of the present invention.

FIG. 5 is a perspective view showing the outline of the threader of the sewing machine according to the embodiment of the present invention. FIG. 5 shows a state before the threading operation. In order to facilitate understanding of the structure of the threading bar 4, the distance between the threading bar 4 and the needle bar 15 is shown as being larger than the actual distance.

When the operator lowers the operating member 17 with one hand, the threading bar 4 is lowered together with the needle bar 15. The needle bar 15 is lowered until a cam control member 20 which controls the movement of the first cam shaft 41 is brought into contact with the needle bar-connecting bracket 13. The first threading-leading portion 2 and the second threading-leading portion 3 are lowered together by the threading shaft 4 until the cam control member 20 is brought into contact with the needle bar-connecting bracket 13 and depresses the needle bar-connecting bracket 13 to cause the needle bar crank rod 12 to reach the lowermost point. Thus, the threading hook 5 and the thread-guiding member 6 do not rotate.

When the cam control member 20 is brought into contact with the needle bar-connecting bracket 13, and the needle bar crank rod 12 has reached the lowermost point, the needle bar 15 and the threading bar 4 are not lowered any more. Here, the first cam shaft 41 is in contact with the end portion of the cam control member 20, and, thus, the first cam shaft 41 moves along the upper edge portion of the first cam hole 21. In this embodiment, due to the shape of the first cam hole 21, the first cam shaft 41 moves as follows.

Figure 6:
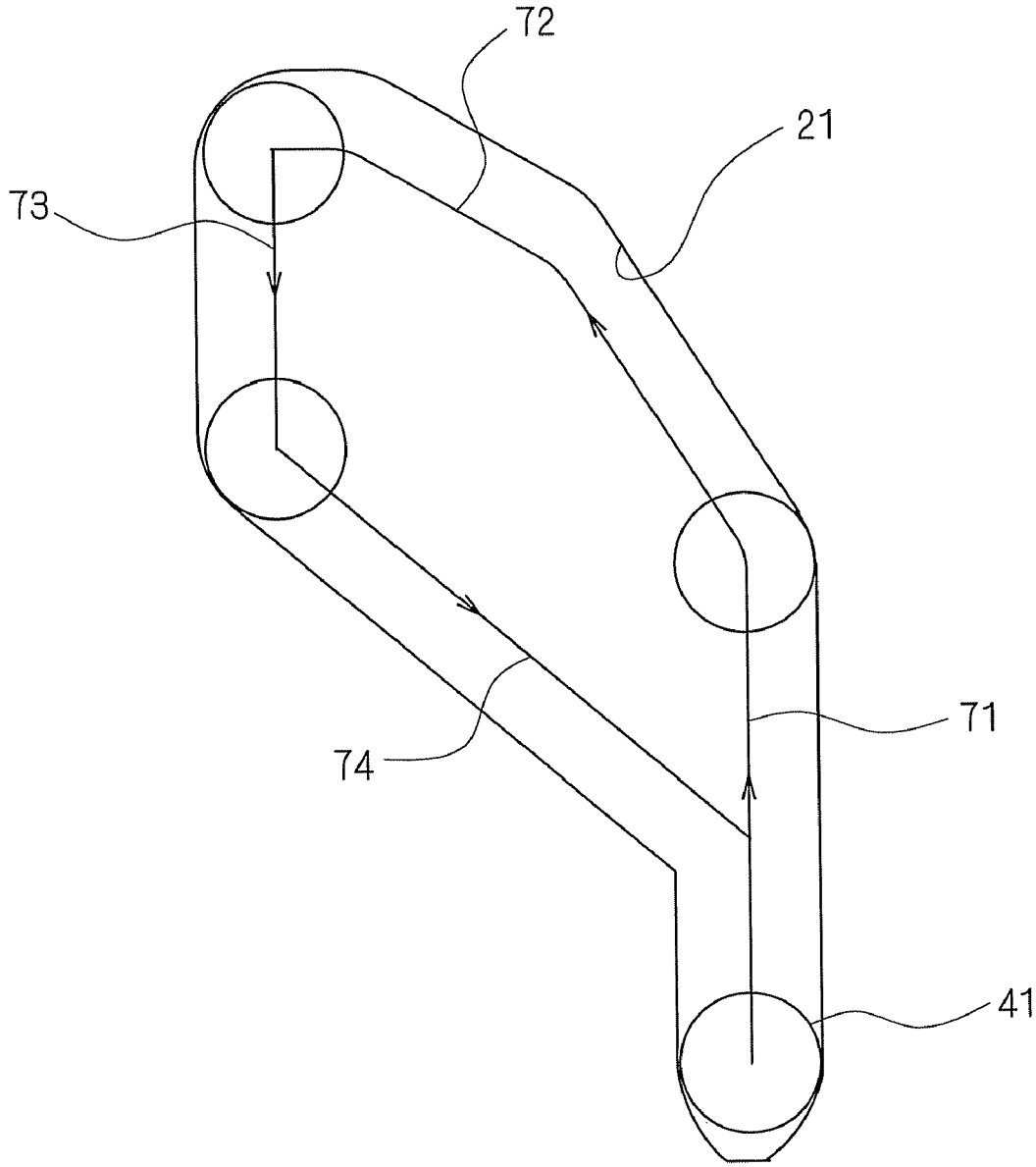
FIG. 6 is a schematic view showing the movement of a first cam shaft that moves in a first cam hole.

FIG. 6 is a schematic view showing the movement of the first cam shaft 41 that moves in the first cam hole 21. As shown in FIG. 6, at the near uppermost portion of the first cam hole 21, the width in the vertical direction is formed so as to be larger than the shaft diameter of the first cam shaft 41. Thus, when the operating member 17 is lifted from the lowermost point, the timing that the first cam shaft 41 starts moving upward can be delayed, and, thus, the movement can be controlled so that only the thread-catching portion 62 of the thread-guiding member 6 is lifted and then the threading hook 5 moves out of the needle hole 14*a*. Accordingly, the threading hook 5 can be pulled out of the needle hole 14*a* after the hook portion 52 of the threading hook 5 reliably catches a top thread, and, thus, the threading operation can be reliably performed.

The specific movement is as follows. When the cam control member 20 is brought into contact with the needle bar-connecting bracket 13, and the needle bar crank rod 12 has reached the lowermost point, the first cam shaft 41 is positioned at the lowermost end of the first cam hole 21 in a state where the first cam shaft 41 is in contact with one end portion of the cam control member 20. When the operating member 17 is further lowered, the first cam shaft 41 moves along a movement route 71, the threading shaft 4 does not rotate, and only the first threading-leading portion 2 and the second threading-leading portion 3 are lowered further. At that time, the second cam shaft 63 starts moving along the second cam hole 31, and the thread-guiding member 6 rotates counterclockwise when viewed from above to start moving toward the needle bar 15. That is to say, the first cam hole 21 and the second cam hole 31 are inclined in the opposite directions, and, thus, the threading hook 5 and the thread-guiding member 6 can be rotated in the opposite directions by the threading shaft 4.

When the operating member 17 is further lowered, the first cam shaft 41 moves along a movement route 72, the threading shaft 4 rotates clockwise when viewed from above, and the threading hook 5 disposed at the lower end moves so as to be inserted into the needle hole 14*a*. When the threading shaft 4 rotates, the second cam shaft 63 moves further along the second cam hole 31 of the second threading-leading portion 3. When the second cam shaft 63 moves further along the second cam hole 31, the thread-guiding member 6 rotates further counterclockwise when viewed from above and moves to a position where the thread-guiding member 6 clamps the needle bar 15.

When the threading hook 5 and the thread-guiding member 6 are rotated in the opposite directions in this manner, a top thread caught by the thread-guiding member 6 can be reliably guided to the threading hook 5. When the threading hook 5 having caught the top thread is pulled out of the needle hole 14*a*, the threading operation can be reliably performed.

Here, in this embodiment, the thread-guiding member 6 is moved further vertically using the compression spring 7 as a biasing member so that a top thread can be more reliably caught by the threading hook 5. That is to say, the lengths of the first cam hole 21 and the second cam hole 31 are set so that the second cam shaft 63 reaches the lowermost point of the second cam hole 31 before the first cam shaft 41 reaches the uppermost point of the first cam hole 21, and, thus, when the operating member 17 is further lowered, the first cam shaft 41 moves along a movement route 73.

In this manner, after the second cam shaft 63 has reached the lowermost point of the second cam hole 31, only the thread-guiding member 6 is lowered further by compressing the compression spring 7, and the operating member 17 reaches the lowermost point. Thus, the thread-guiding member 6 can end the rotational movement and be depressed to a position lower than the hook portion 52 of the threading hook 5 inserted into the needle hole 14*a*, before the threading hook 5 is inserted into the needle hole 14*a*.

When the operating member 17 starts moving upward, only the thread-guiding member 6 is lifted due to the elastic force of the compression spring 7, and a top thread caught by the thread-guiding member 6 is reliably caught by the hook portion 52 of the threading hook 5 that has been inserted into the needle hole 14*a*. In this state, when the operating member 17 is further lifted, the first cam shaft 41 moves along a movement route 74, the threading shaft 4 rotates counterclockwise when viewed from above, and the threading hook 5 arranged at the lower end moves out of the needle hole 14*a*. At that time, the thread caught by the hook portion 52 passes through the needle hole 14*a*, and, thus, the threading operation is completed.

FIGS. 7 to 9 show front views, schematic views and plan views showing the movement of the threader of the sewing machine according to the embodiment of the present invention. FIG. 7A shows a front view of the initial state and a schematic view of the cam state. FIG. 7B shows a plan view of the positional relationship between the threading hook 5 and the thread-guiding member 6 in the initial state. FIG. 7C shows a front view of a state where the cam control member 20 is lowered, and the needle bar crank rod 12 has reached the lowermost point, and a schematic view of the cam state. FIG. 7D shows a plan view of the positional relationship between the threading hook 5 and the thread-guiding member 6 in a state where the cam control member 20 is lowered, and the needle bar crank rod 12 has reached the lowermost point. FIG. 7E shows a front view of a state where the first cam shaft 41 has been lifted along the movement route 71, and a schematic view of the cam state. FIG. 7F shows a plan view of the positional relationship between the threading hook 5 and the thread-guiding member 6 in a state where the first cam shaft 41 has been lifted along the movement route 71.

Figure 7A:
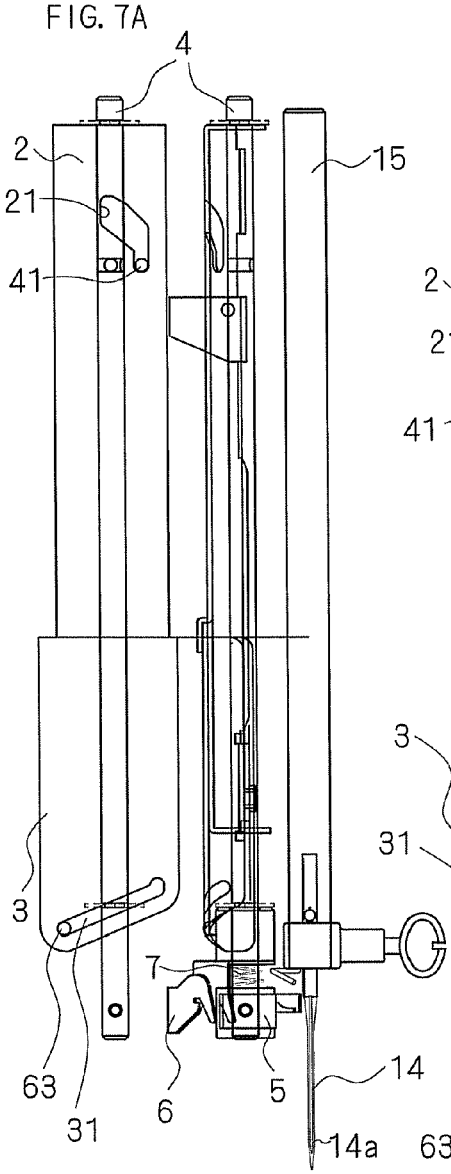
FIGS. 7A-7F shows front views, schematic views and plan views showing the movement of the threader of the sewing machine according to the embodiment of the present invention.
Figure 7C:
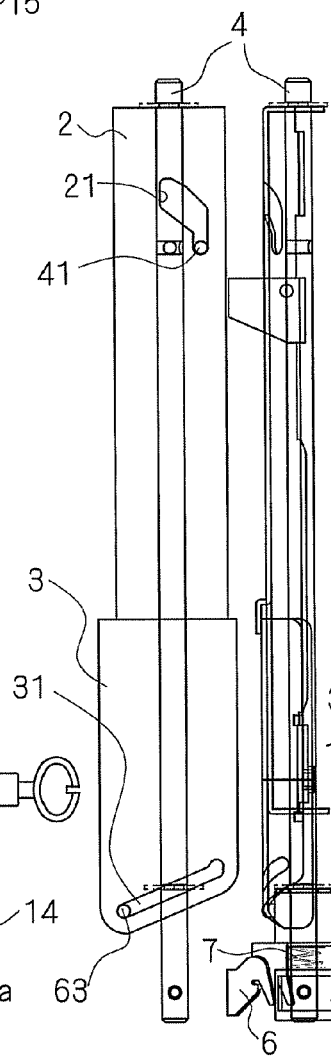

When the operator lowers the operating member 17 with one hand from the position shown in FIG. 7A, the threading bar 4 is lowered together with the needle bar 15, and the threading bar 4 is lowered until the cam control member 20 controlling the movement of the first cam shaft 41 is brought into contact with the needle bar-connecting bracket 13, and the needle bar crank rod 12 reaches the lowermost point as shown in FIG. 7C. The threading hook 5 and the thread-guiding member 6 do not rotate until the cam control member 20 is brought into contact with the needle bar-connecting bracket 13, and the needle bar crank rod 12 reaches the lowermost point, and, thus, the positional relationship between the threading hook 5 and the thread-guiding member 6 does not change as shown in FIGS. 7B and 7D.

Figure 7E:
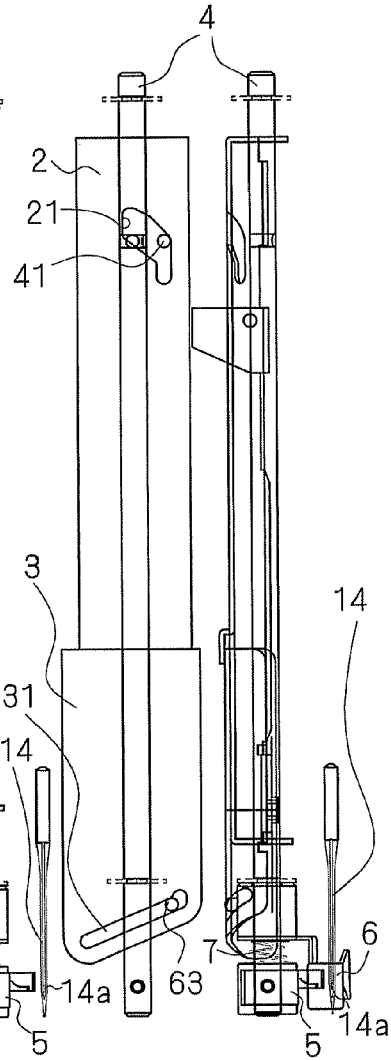
Figure 7B:
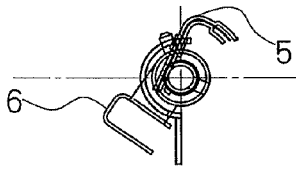
Figure 7D:
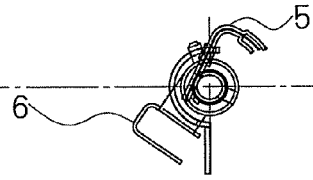
Figure 7F:
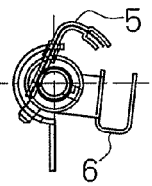

When the operating member 17 is further lowered from the position shown in FIG. 7C to reach the position shown in FIG. 7E, that is, when the first cam shaft 41 has reached the upper edge portion of the first cam hole 21, the threading shaft 4 does not rotate, and only the first threading-leading portion 2 and the second threading-leading portion 3 are lowered further. Thus, the threading hook 5 does not rotate, and does not move from the position shown in FIGS. 7B and 7D. Conversely, the second cam shaft 63 starts moving along the second cam hole 31, and the thread-guiding member 6 rotates counterclockwise when viewed from above as shown in FIG. 7F to start moving toward the needle bar 15.

Figure 8A:
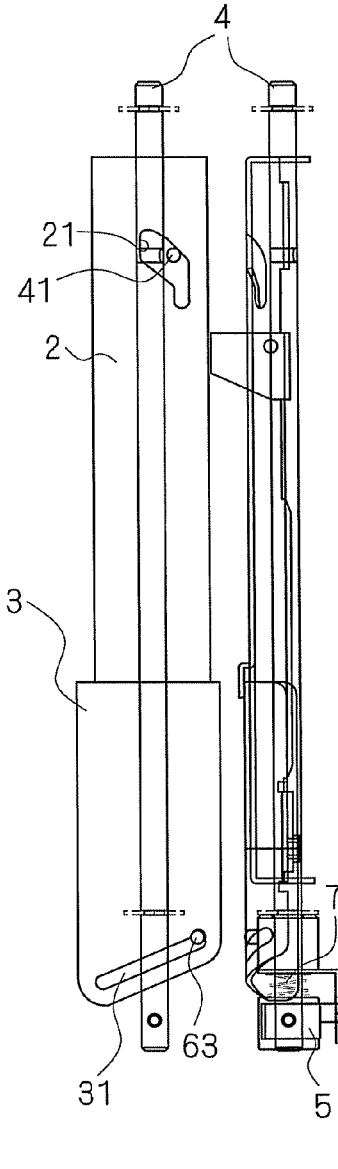
FIGS. 8A-8F shows front views, schematic views and plan views showing the movement of the threader of the sewing machine according to the embodiment of the present invention.
Figure 8C:
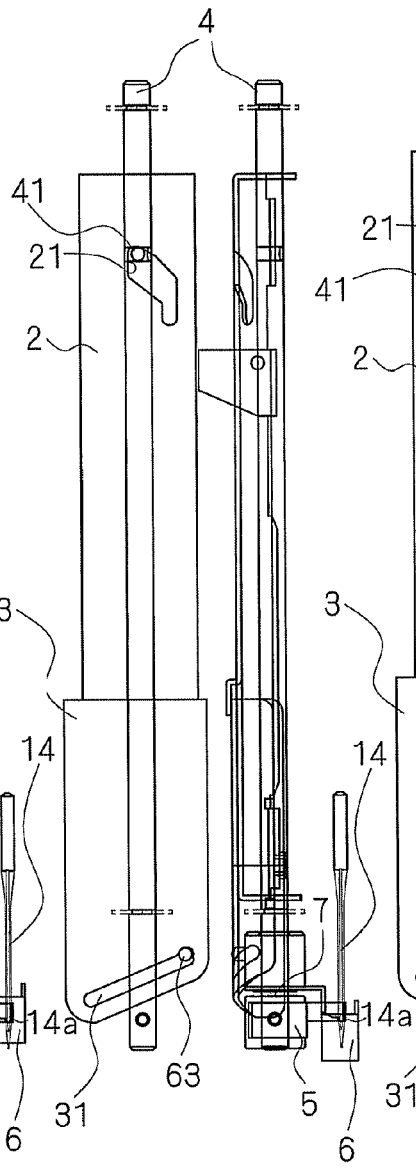
Figure 8E:
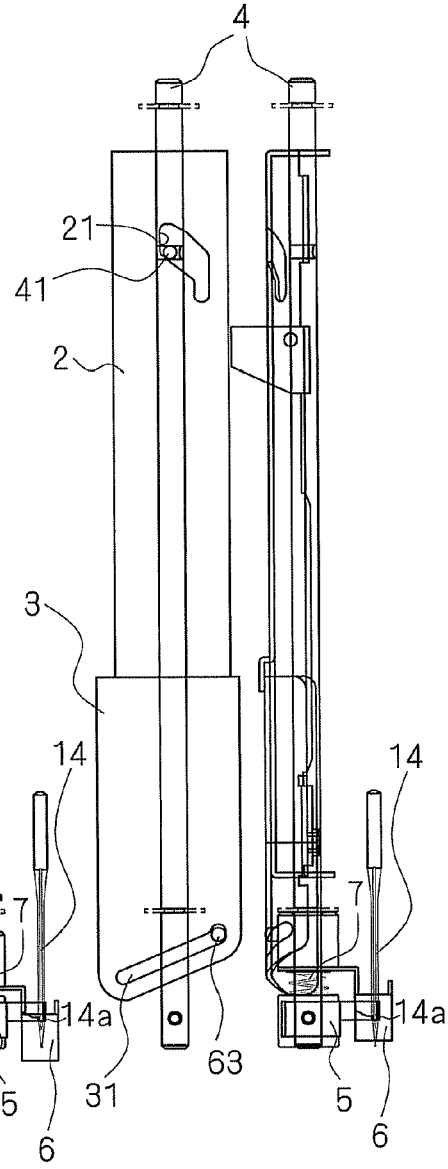
Figure 8B:
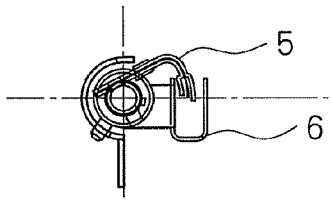
Figure 8D:
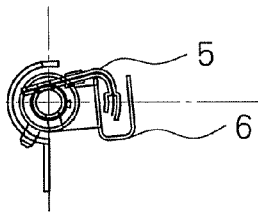
Figure 8F:
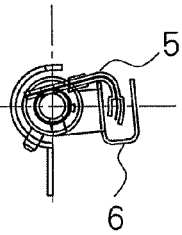

FIG. 8A shows a front view of a state immediately before the threading hook 5 is inserted into the needle hole 14*a*, and a schematic view of the cam state. FIG. 8B shows a plan view of the positional relationship between the threading hook 5 and the thread-guiding member 6 immediately before the threading hook 5 is inserted into the needle hole 14*a*. FIG. 8C shows a front view in a state where the operating member 17 is at the lowermost point, and a schematic view of the cam state. FIG. 8D shows a plan view of the positional relationship between the threading hook 5 and the thread-guiding member 6 in a state where the operating member 17 is at the lowermost point. FIG. 8E shows a front view in a state where the threading operation has been completed, and a schematic view of the cam state. FIG. 8F shows a plan view of the positional relationship between the threading hook 5 and the thread-guiding member 6 in a state where the threading operation has been completed.

As shown in FIG. 8A, when the operating member 17 is further lowered, the first cam shaft 41 moves along the upper edge portion of the first cam hole 21, and the threading shaft 4 rotates clockwise when viewed from above. The first threading-leading portion 2 and the second threading-leading portion 3 are also lowered further. Thus, as shown in FIG. 8B, the threading hook 5 rotates toward the needle hole 14*a*. Conversely, the second cam shaft 63 continues moving along the second cam hole 31. As shown in FIG. 8C, in a state where the operating member 17 is at the lowermost point, the hook portion 52 of the threading hook 5 is inserted into the needle hole 14*a*, and the thread-catching portion 62 of the thread-guiding member 6 is depressed to a position directly below the hook portion 52.

That is to say, the lengths of the first cam hole 21 and the second cam hole 31 are set so that the second cam shaft 63 reaches the lowermost point of the second cam hole 31 before the first cam shaft 41 reaches the uppermost point of the first cam hole 21, and, thus, when the operating member 17 is lowered, the first cam shaft 41 moves along the movement route 73. In this manner, after the second cam shaft 63 has reached the lowermost point of the second cam hole 31, only the thread-guiding member 6 is lowered further while compressing the compression spring 7, and the operating member 17 reaches the lowermost point. Accordingly, the movement timing of the hook portion 52 of the threading hook 5 and the thread-catching portion 62 of the thread-guiding member 6 can be adjusted by adjusting the length, the inclination and the like of the cam holes, and, thus, the threading operation can be more reliably performed.

Thus, the thread-guiding member 6 ends the rotational movement before the threading hook 5 is inserted into the needle hole 14*a* and, in a state where the operating member 17 is at the lowermost point, the thread-guiding member 6 is depressed to a position lower than the hook portion 52 of the threading hook 5 that is inserted into the needle hole 14*a*. In this state, the compression spring 7 is depressed, and, thus, when the operator releases the operating member 17, the thread-guiding member 6 is lifted due to the elastic force of the compression spring 7. Thus, as shown in FIGS. 8E and 8F, the positional relationship in the horizontal direction between the threading hook 5 and the thread-guiding member 6 does not change, and only the thread-guiding member 6 is lifted. Accordingly, a top thread caught by the thread-catching portion 62 is lifted to the hook portion 52 of the threading hook 5 and is reliably caught by the hook portion 52.

Figure 9A:
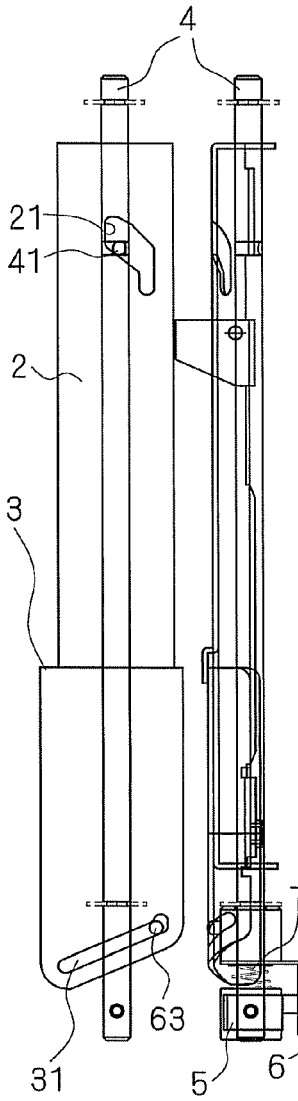
FIGS. 9A-9F shows front views, schematic views and plan views showing the movement of the threader of the sewing machine according to the embodiment of the present invention.
Figure 9C:
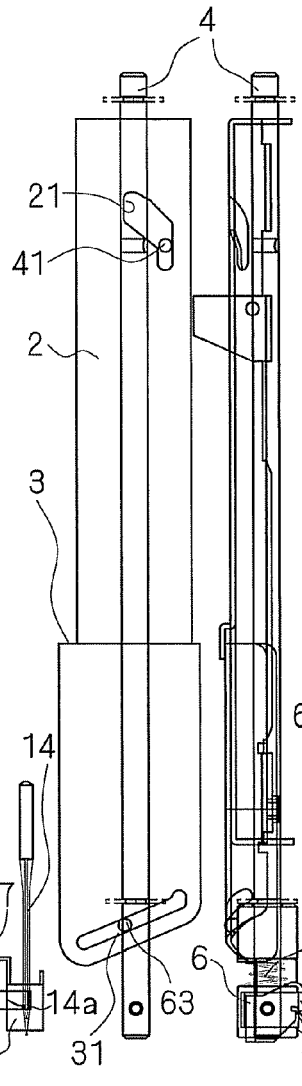
Figure 9E:
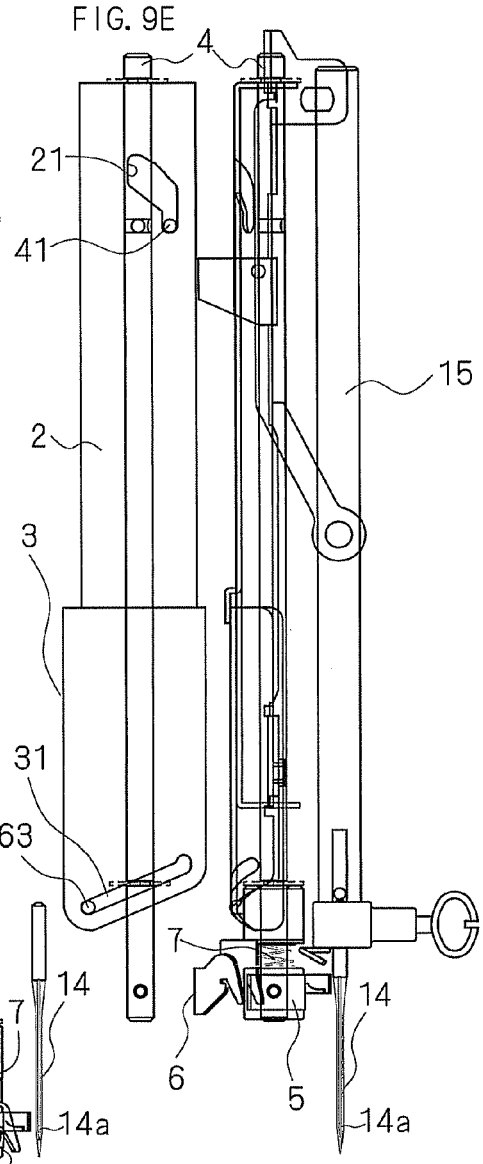
Figure 9B:
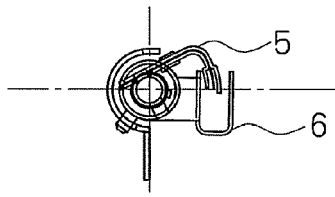
Figure 9D:
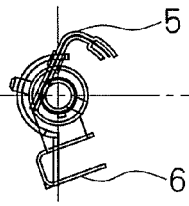
Figure 9F:
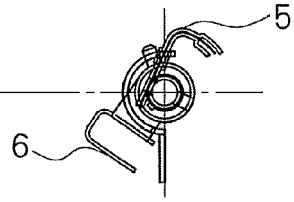

FIG. 9A shows a front view of a state where the threading hook 5 has moved out of the needle hole 14*a*, and a schematic view of the cam state. FIG. 9B shows a plan view of the positional relationship between the threading hook 5 and the thread-guiding member 6 in a state where the threading hook 5 has moved out of the needle hole 14*a*. FIG. 9C shows a front view of a state where the cam control member 20 has been brought into contact with the needle bar-connecting bracket 13, and a schematic view of the cam state. FIG. 9D shows a plan view of the positional relationship between the threading hook 5 and the thread-guiding member 6 in a state where the cam control member 20 has been brought into contact with the needle bar-connecting bracket 13. FIG. 9E shows a front view of the initial state and a schematic view of the cam state. FIG. 9F shows a plan view of the positional relationship between the threading hook 5 and the thread-guiding member 6 in the initial state.

As shown in FIG. 9A, as the operating member 17 is lifted, the threading hook 5 in which the hook portion 52 has caught a top thread moves out of the needle hole 14*a* as shown in FIG. 9B. Accordingly, the top thread passes through the needle hole 14*a*, and, thus, the threading operation is performed.

When the operating member 17 is further lifted, the first cam shaft 41 moves along the movement route 74, that is, the lower edge portion of the first cam hole 21, and returns to a state where the cam control member 20 has been brought into contact with the needle bar-connecting bracket 13 as shown in FIG. 9C. As the first cam shaft 41 moves along the upper edge portion of the first cam hole 21, the threading shaft 4 rotates counterclockwise when viewed from above. Conversely, the second cam shaft 63 continues moving along the second cam hole 31, and the thread-guiding member 6 rotates clockwise when viewed from above as shown in FIG. 9D.

When the operating member 17 is further lifted, the first cam shaft 41 returns to the lowermost end of the first cam hole 21, and the needle bar 15 and the threading shaft 4 are also lifted. The second cam shaft 63 continues movement along the second cam hole 31, the thread-guiding member 6 rotates clockwise when viewed from above and returns to the original position as shown in FIG. 9F.

As described above, according to this embodiment, two cam holes are inclined in the opposite directions, and, thus, the threading hook 5 and the thread-guiding member 6 can be rotated in the opposite directions by the threading shaft 4. Thus, the entire head portion can be made compact, and the number of parts can be reduced, which reduces the cost. Furthermore, even during a sewing operation that requires fine movement, the inertia of the moving portion is small, and, thus, the sewing speed does not have to be reduced in order to maintain sewing precision.

It should be appreciated that the present invention can be worked with various modifications made to the above-described embodiment without departing from the gist of the invention.

The invention claimed is:

1. A threader of a sewing machine, comprising:

a threading shaft arranged near a needle bar for moving a supporting sewing needle vertically capable of moving vertically and supported for rotating around an axis;

a threading hook having a hook portion fixed to a lower end portion of the threading shaft, and capable of being inserted into a needle hole of the sewing needle, and a first guiding portion for guiding the hook portion to the needle hole;

a positioning member for regulating a lowermost position of the threading shaft to a position where the height of the hook portion matches that of the needle hole of the sewing needle;

a first rotary mechanism for rotating the first guiding portion by a predetermined angle so that the hook portion is inserted into the needle hole of the sewing needle at a near lowermost point of the threading shaft; and a thread-guiding member for guiding a top thread to the hook portion near the lowermost point of the threading shaft, wherein the thread-guiding member comprises a thread-catching portion for catching a thread, and a second guiding portion for guiding the thread-catching portion toward the sewing needle, the threader further comprises a second rotary mechanism for rotating the second guiding portion by a predetermined angle so that the thread-catching portion is guided towards the needle bar and a thread caught by the thread-catching portion is guided to a position near a hook portion of the threading hook near lowermost point of the threading shaft;

the first rotary mechanism and the second rotary mechanism rotate the threading hook and the thread-guiding member in opposite directions;

the threader comprises a threading-leading member that is externally fitted or internally fitted to the threading shaft thereby being fixed to a body of the sewing machine, and that has a first cam hole and a second cam hole on a circumferential face, wherein the first rotary mechanism comprises the first cam hole, and a first cam shaft that is disposed on the threading shaft and that is fitted to the first cam hole, the second rotary mechanism comprises the second cam hole, and a second cam shaft that is disposed on the thread-guiding member and that is fitted to the second cam hole, and a direction in which the first cam hole is inclined is an opposite of a direction in which the second cam hole is inclined, a width in the vertical direction of the first cam hole at a near uppermost portion is larger than a shaft diameter of the first cam shaft, and a biasing member is disposed between the threading hook and the thread-guiding member so as to bias the threading hook and the thread-guiding member away from each other.

2. The threader of the sewing machine of claim 1, comprising:

an operating member that can operate the threading shaft and that can move the threading shaft vertically.

* * * * *